United States Patent [19]

Gillett et al.

[11] Patent Number: 4,517,927

[45] Date of Patent: May 21, 1985

[54] STEAM GENERATOR FOR LIQUID METAL FAST BREEDER REACTOR

[75] Inventors: James E. Gillett, Greensburg; Daniel C. Garner, Murrysville; Arthur L. Wineman, Greensburg; Robert M. Robey, North Huntingdon, all of Pa.

[73] Assignee: The United States of America as represented by the United States Department of Energy, Washington, D.C.

[21] Appl. No.: 379,812

[22] Filed: May 19, 1982

[51] Int. Cl.[3] ..... F22B 37/24

[52] U.S. Cl. ..... 122/510; 122/511; 165/162

[58] Field of Search ..... 122/511, 510, 32, 33, 122/235 G, 235 K; 165/162

[56] References Cited

U.S. PATENT DOCUMENTS

| | | | |
|---|---|---|---|
| 3,212,567 | 10/1965 | Romanos | 165/162 |
| 3,807,365 | 4/1974 | Lyman et al. | 122/32 |
| 4,088,182 | 5/1978 | Basdekas et al. | 122/32 X |
| 4,198,929 | 4/1980 | Forestier et al. | 122/32 |

*Primary Examiner*—Edward G. Favors

[57] ABSTRACT

Improvements in the design of internal components of J-shaped steam generators for liquid metal fast breeder reactors. Complex design improvements have been made to the internals of J-shaped steam generators which improvements are intended to reduce tube vibration, tube jamming, flow problems in the upper portion of the steam generator, manufacturing complexities in tube spacer attachments, thermal stripping potentials and difficulties in the weld fabrication of certain components.

9 Claims, 21 Drawing Figures

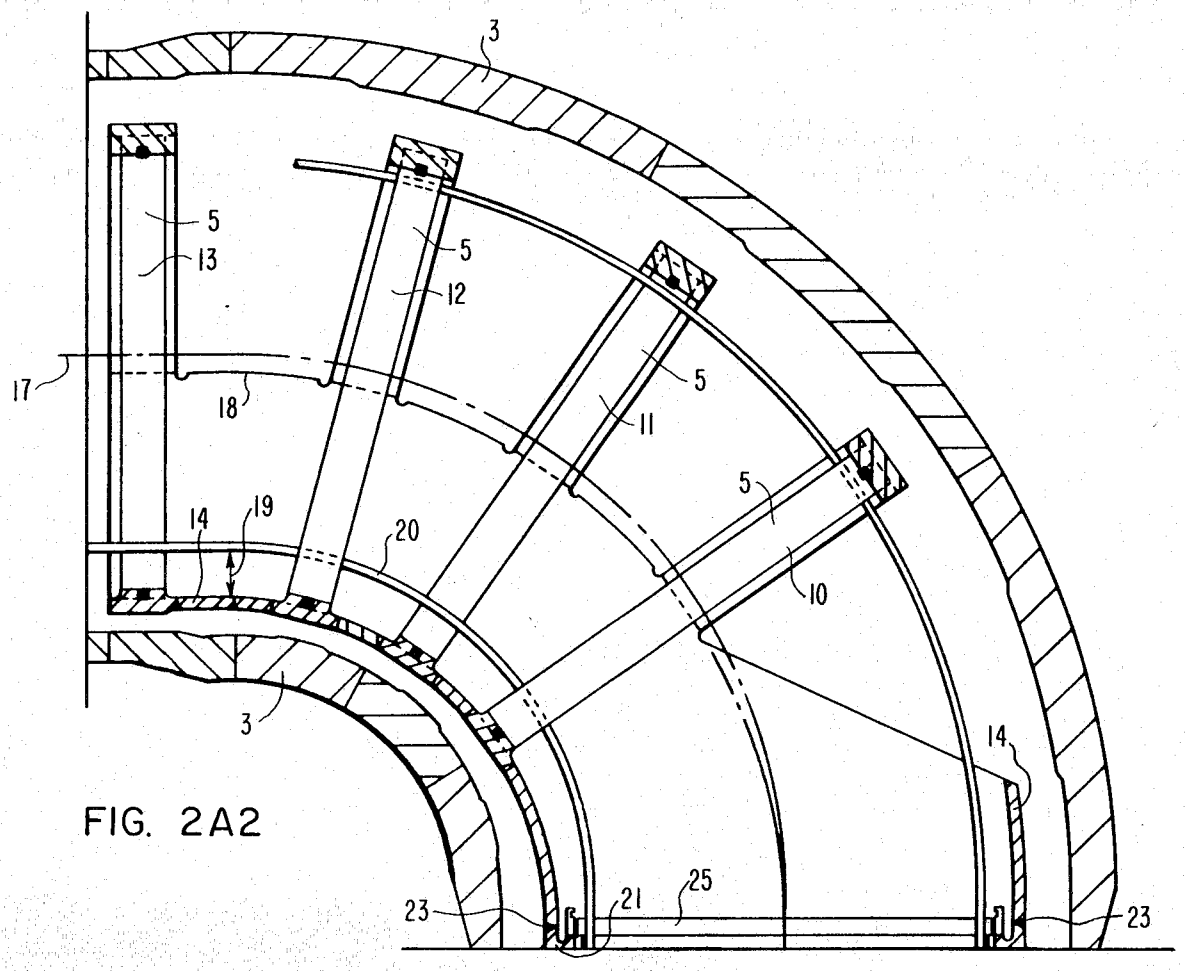
FIG. 2A2

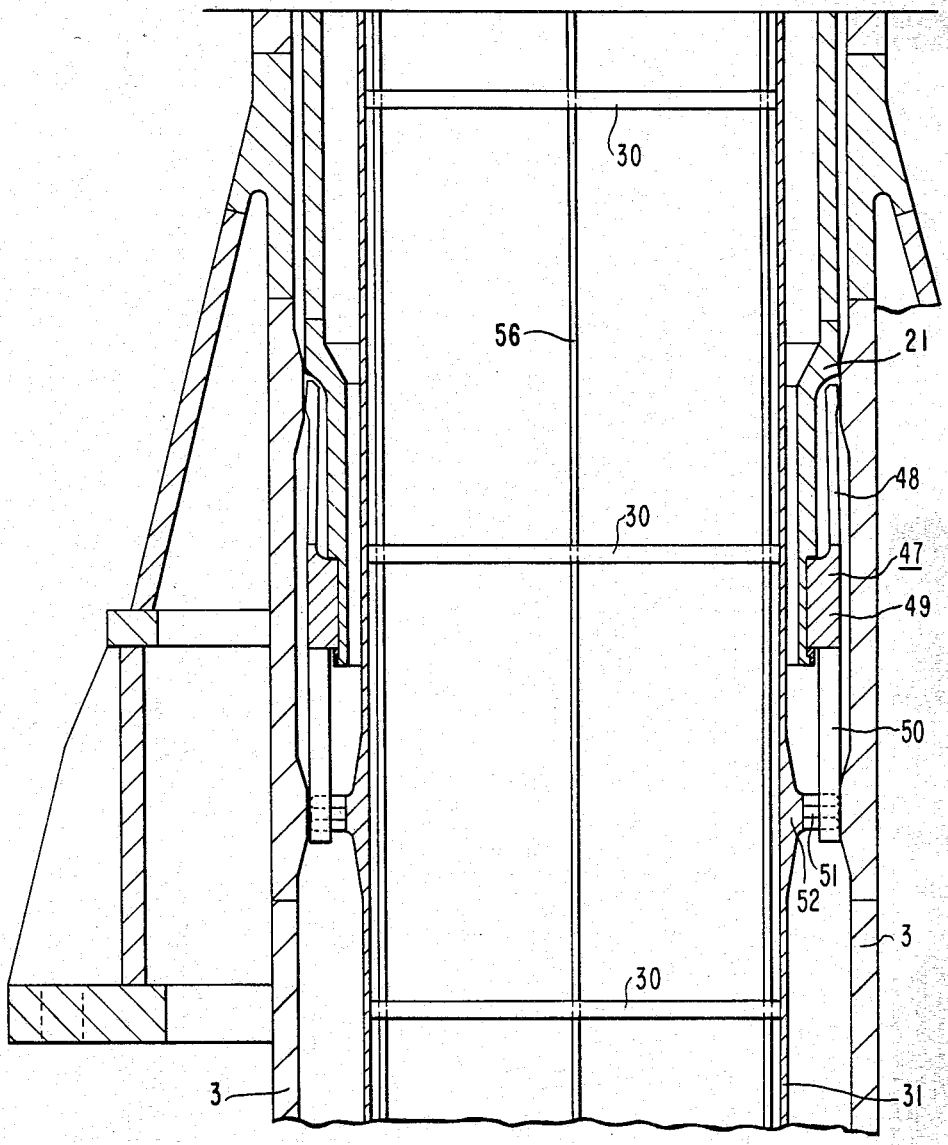
FIG. 2D
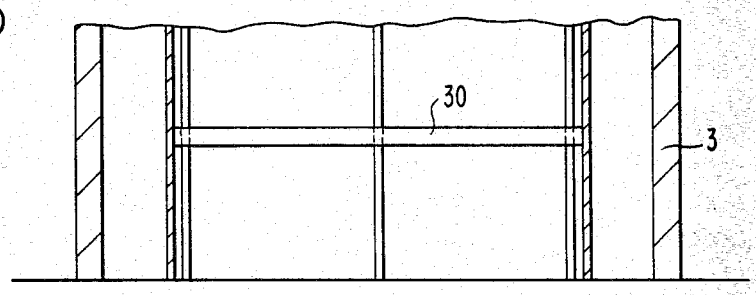

STEAM GENERATOR FOR LIQUID METAL FAST BREEDER REACTOR

GOVERNMENT CONTRACT

This invention was conceived during the performance of a contract with the United States Government designated DE-AC15-76CL02395.

BACKGROUND OF THE INVENTION

1. Field of the Invention

This invention relates to J-shaped steam generators for liquid metal fast breeder reactors.

2. Description of the Prior Art

The steam generators used to transfer energy from a liquid coolant (usually liquid sodium) to water are key components in the successful operation of a Liquid Metal Fast Breeder Reactor (LMFBR) power plant. There are three major designs of steam generators which represent the state of the art of current U.S. technology. These are the helical steam generator, the duplex tube with expandable shell, and the "J-shaped" steam generator, by which term is meant a steam generator having a curved or bent section, especially at the top.

A prototype J-shaped steam generator has been designed for use in a LMFBR. A number of problems with the prototype design have been identified as a result of testing.

It is desired to provide design alterations to the prototype J-shaped steam generator to improve the safety and performance of the unit.

SUMMARY OF THE INVENTION

Certain features of the internals of the steam generator have been redesigned to eliminate prior deficiencies. These features are:

1. staggered support of alternate rows of steam generator tubes in the curved region;
2. eccentricity between the elbow shroud and the steam generator shell;
3. weldment connection between the elbow shroud and the thermal liner;
4. a lowered tube bundle inlet with respect to the sodium inlet nozzle;
5. an improved labyrinth disc seal between the thermal liner and the vessel nozzle annulus;
6. improved thermal liner/elbow shroud support means;
7. improved attachment means for tube spacer plates;
8. a lowered sodium shroud outlet with respect to the vessel sodium outlet;
9. a bottom supported shroud; and
10. improved shroud support features.

DETAILED DESCRIPTION OF THE INVENTION

Figure 1A:
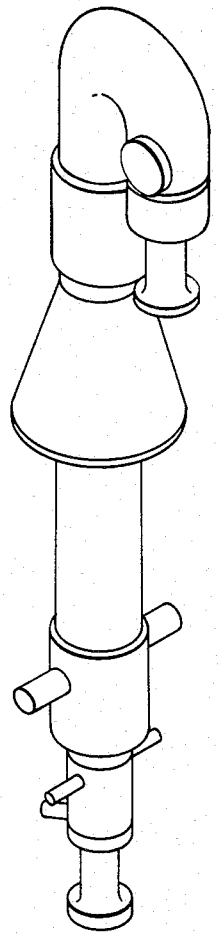
FIGS. 1A and 1B are general schematics of a J-tube steam generator.
Figure 1B:
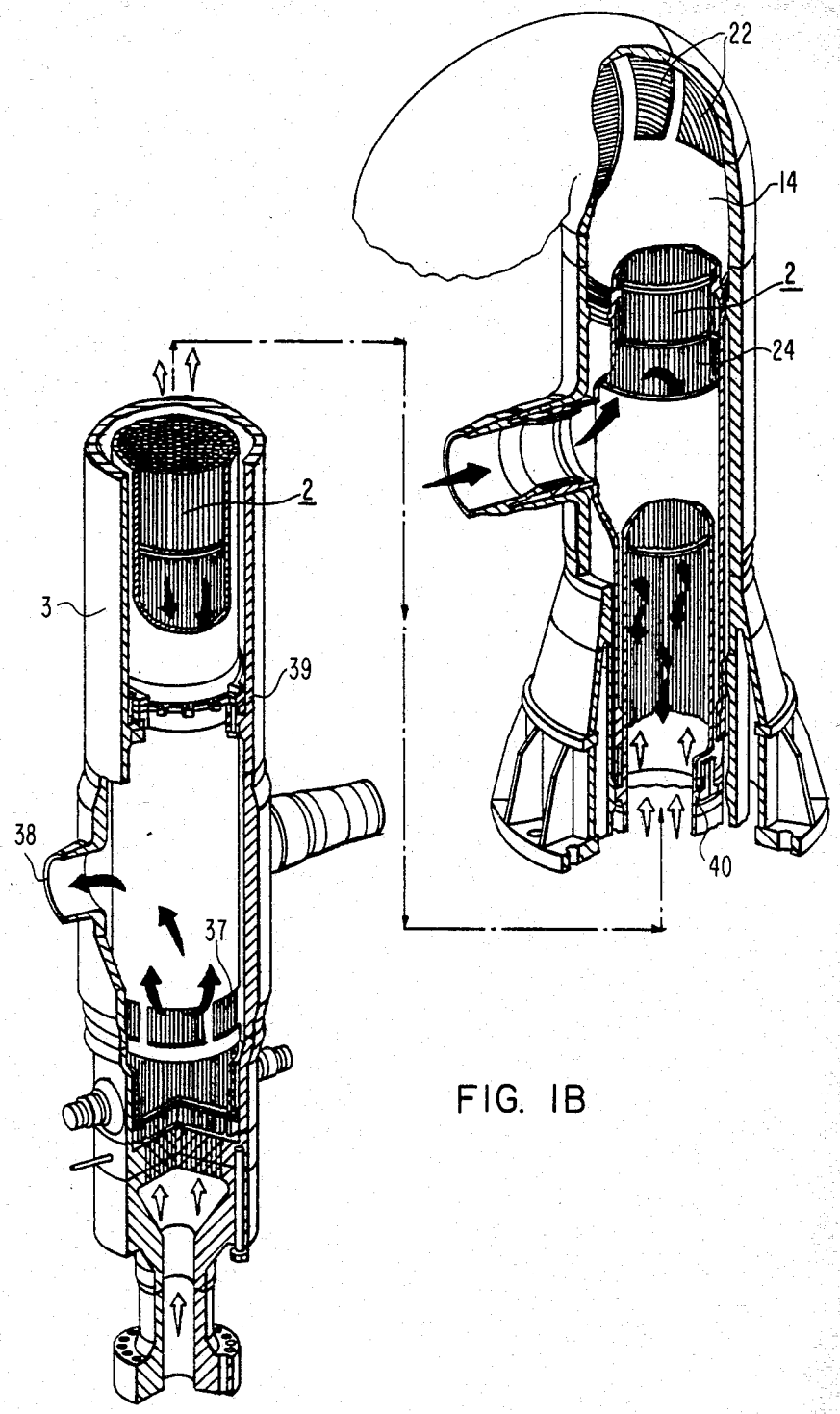

General (FIGS. 1A, 1B)

The energy generated by the reactor is to be removed from the primary system by three heat removal systems each comprising three steam generators. Two of the steam generators in each system are designated evaporators and one is designated a superheater. All steam generators are almost identical in design, and any evaporator is interchangeable with any superheater by removing or installing an individual water flow throttle used at the inlet of each evaporator tube to ensure boiling flow stability in the evaporator.

The evaporators and superheaters are installed in a vertical position as shown in FIGS. 1A and 1B and are shell and tube heat exchangers with fixed tube sheets and with a bend (usually 90°) in the shell and tube bundle ("J-tube" configuration) to provide for differential thermal expansion between the tubes and the shell. FIGS. 1A and 1B depict a bend of 180°. Sodium flow (solid arrows) is vertically downward, parallel with the tubes on the shell side from the sodium inlet nozzle 1 near the top of the active straight section countercurrent to the steam/water flow upward inside tubes 2. There are 739 tubes 2 ($\frac{5}{8}$" outside diameter) in each unit with an average active tube 2 length of about 46 feet.

The material of construction for shell 3, tube sheets, tubes 2 and other elements of the evaporator and superheater in $2\frac{1}{4}$ CR-1-MO.

Figure 2A:
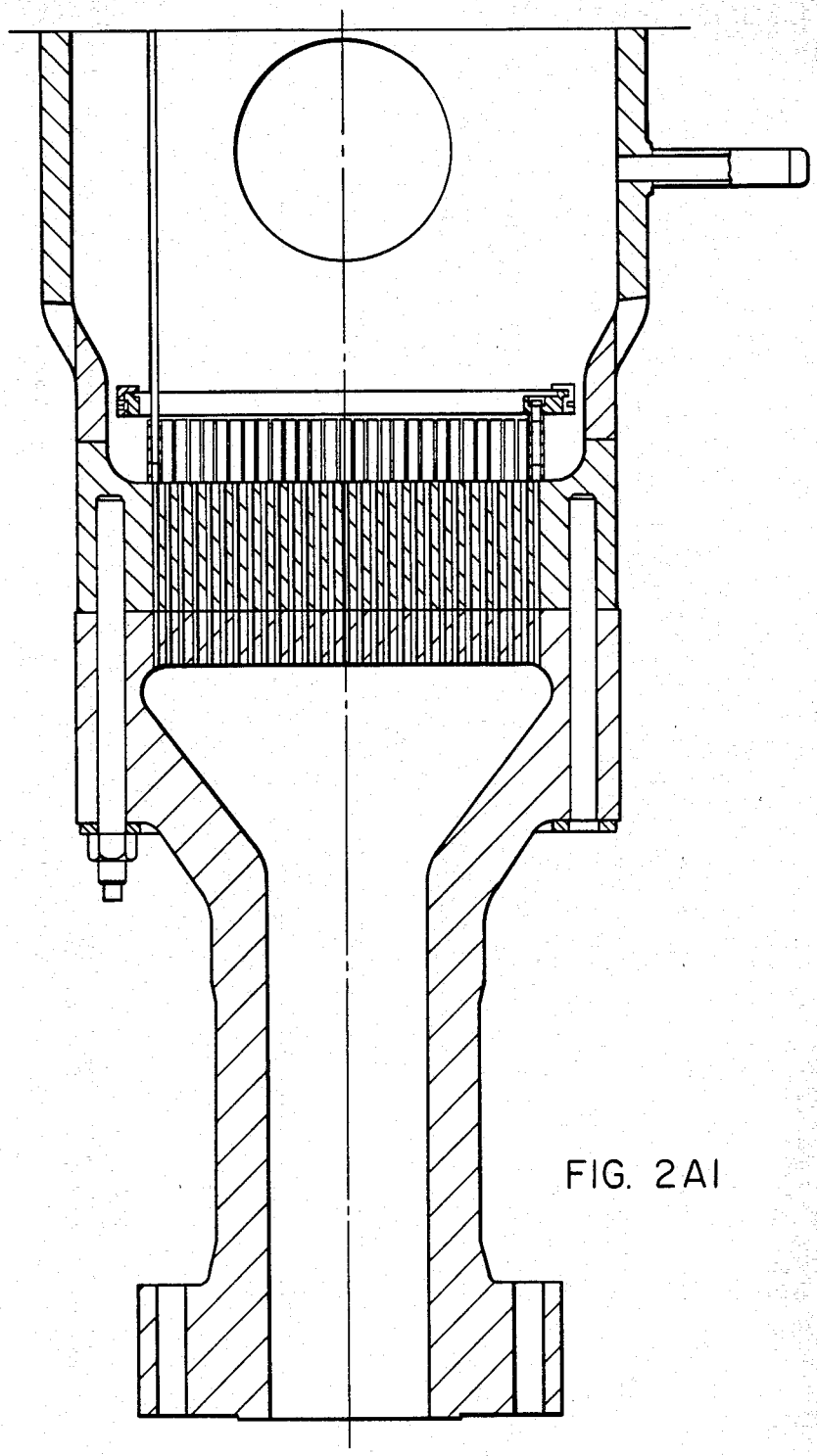
FIG. 2 (A1, A2 through G) is a profile view of a J-shaped steam generator.
Figure 2B:
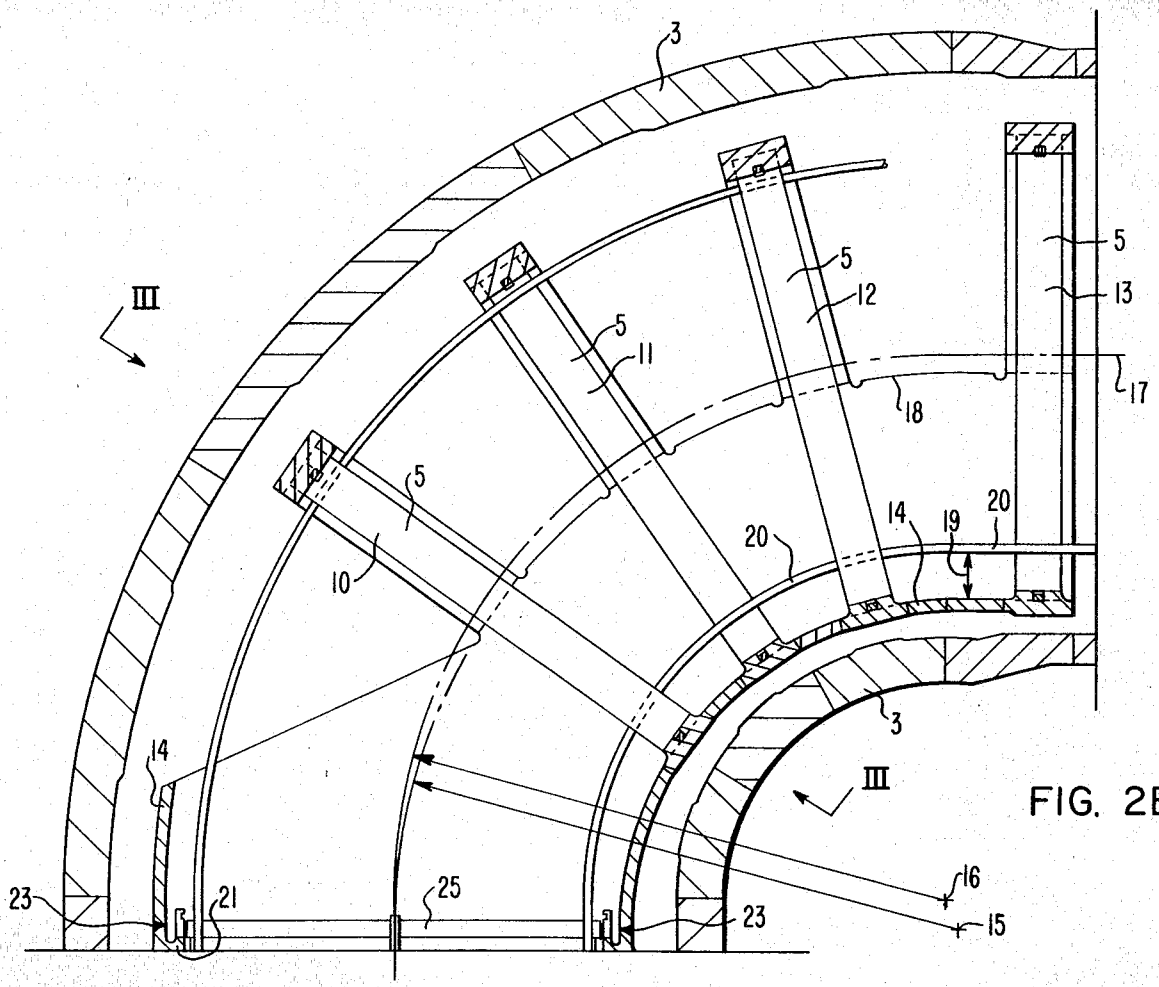
Figure 3:
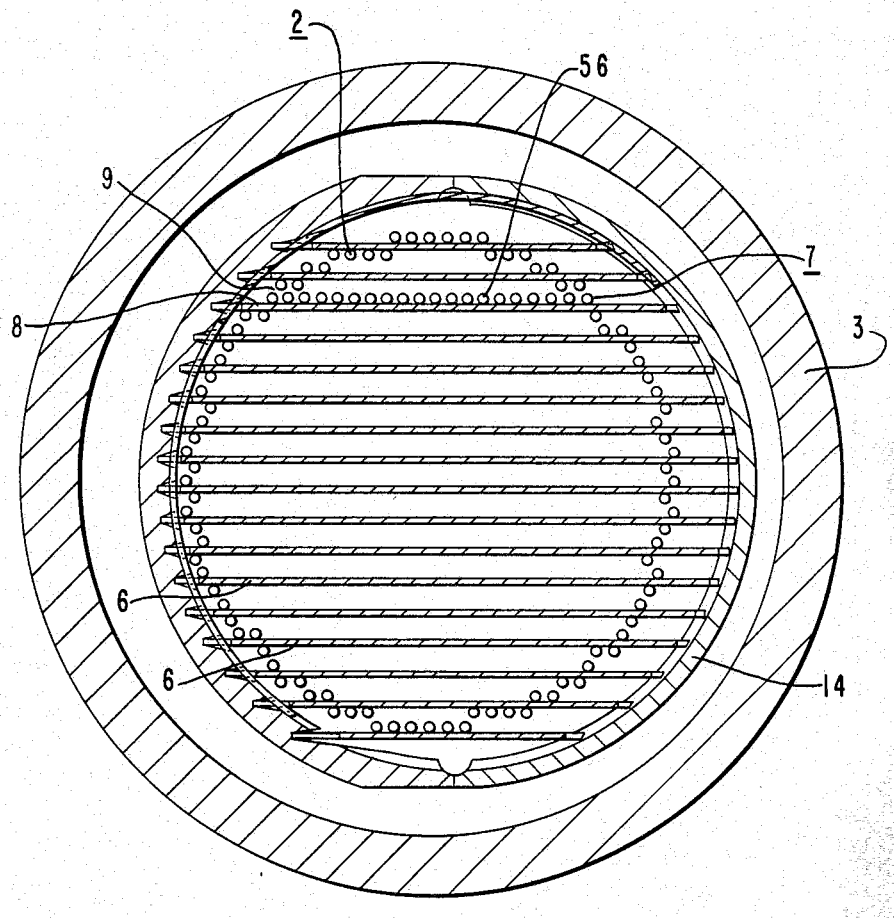
FIG. 3 is a section from FIG. 2B.

Steam Generator Tube Support (FIGS. 2B, 3)

During heat up of the steam generator, differential thermal expansion between tubes 2 and shell 3 is accommodated by flexing of the tubes 2 in the curved J-section of the tubes. This expansion must be accommodated otherwise tubes 2 will buckle and eventually fail resulting in a sodium/water reaction. It is therefore important to permit tubes 2 to move freely during thermal expansion. Yet tubes 2 require lateral support for seismic events, shipping and proper tube-to-tube spacing. This results in the problem of how to properly support tubes 2 with relatively long spans. At present, lateral support in the bend section is provided by support bars between adjacent rows of tubes (not shown), used to provide lateral support while allowing free movement therethrough. It has been determined that one support at the 90° location will not provide proper tube 2 spacing. Prior attempts with additional similar supports at 30° and 60° resulted in failure and buckling of the tubes 2 due to differential expansion between tubes 2 and subsequent jamming in the support bars.

According to this invention, referring to FIGS. 3 and 2B, the array of tubes 2 is to be laterally supported by a plurality, preferably 4 per 90° of bend, of support grids 5 each of which has ribs 6 which provide lateral support to only every other row of tubes 2. A given row of tubes 2 is supported laterally by every other support plate.

In FIG. 3, many tubes 2 have been omitted for clarity, but of course the array of all tubes would substantially fill the area within the cross-section of FIG. 3. One row of tubes, row 7, is complete. This row 7 is supported by rib 8 on one side, but on the opposite side of row 7, there is no rib 6 but rather a gap 9. Assuming the cross-section of FIG. 3 is through the lowest tube support grid 5, labeled 10 in FIG. 2B, then the position corresponding to gap 9 in grid 10 will have a rib 6 in grid 11. Similarly, the position corresponding to rib 8 in grid 10 (FIG. 3) will be a gap in grid 11. This pattern of support repeats between alternate grids such that grids 10 and 12 are identical, and grids 11 and 13 are identical.

This design provides for tube support and spacing, and allows thermal expansion into gaps 9.

Elbow Shroud Placement (FIG. 2B)

The array of tubes 2 within the steam generator is surrounded by a container called the shroud. In the upper part of the steam generator in the vicinity of the bend this shroud is termed the elbow shroud 14. A gap must exist between the inner row of tubes and the elbow shroud 14 to prevent contact of the inner row of tubes with elbow shroud 14 during thermal expansion. This gap tends to increase the overall diameter of the steam generator.

According to this invention the centerline 18 of the elbow shroud 14 is not identical with the shell centerline 17. This is shown in FIG. 2B in which the center of the arc of the elbow shroud centerline 18, point 15, is no identical to the center 16 of the arc of tubes 2 and shell 3, point 16. These two points 15 and 16 are separated by approximately 2.5 inches. Tubes 2 remain concentric with respect to shell 3 but an eccentricity exists between elbow shroud 14 and tubes 2. This eccentricity results in a gain of between 1 inch to $2\frac{1}{2}$ inches in the width of gap 19 between the elbow shroud and the nearest row 20 of tubes 2. The variation in the size of gap 19, shown in FIG. 2B, roughly corresponds to the variation in the deflection in tubes 2 caused by thermal contraction. The size of the gap 19 can therefore be minimized rather than maximized to be appropriate to the size of the worst case tube contraction. Alternatively a greater $\Delta T$ may be accommodated by the steam generator without the inside tube thermally contracting and contacting elbow shroud 14. This increases the size of the thermal transients that can be accommodated by the steam generator of a given diameter.

Elbow Shroud/Inlet Thermal Liner Attachment Means (FIS. 1B, 2B, 2C)

In the design of the steam generator under the prior art the connection between a thermal liner 21 and elbow shroud 14 has been a mechanical joint. These mechanical joints are difficult to structurally analyze for thermally applied loads due to the required geometry of the mechanical joint.

During the fabrication of the steam generator by the prior art elbow shroud 14 is installed after tubes 2 are installed. The mechanical joint between elbow shroud 14 and inlet thermal liner 21 has been required because of the need to accomplish this joint after the installation of tubes 2 at which time a welding operation would be extremely difficult. By this invention elbow shroud 14 is left open on the top side (see openings 22 in FIG. 1B) to permit tubing of the unit with elbow shroud 14 and thermal liner 21 in place. Tube support top rings (not shown in the drawings) are welded in place after tubing. The thermal liner 21 material is to be 316 stainless steel instead of $2\frac{1}{4}$ CR-1MO to facilitate welding. The connection between elbow shroud 14 and thermal liner 21 is now to be a weldment 23 as opposed to a bolted design and therefore these components can be considered to be an integral unit.

Figure 2C:
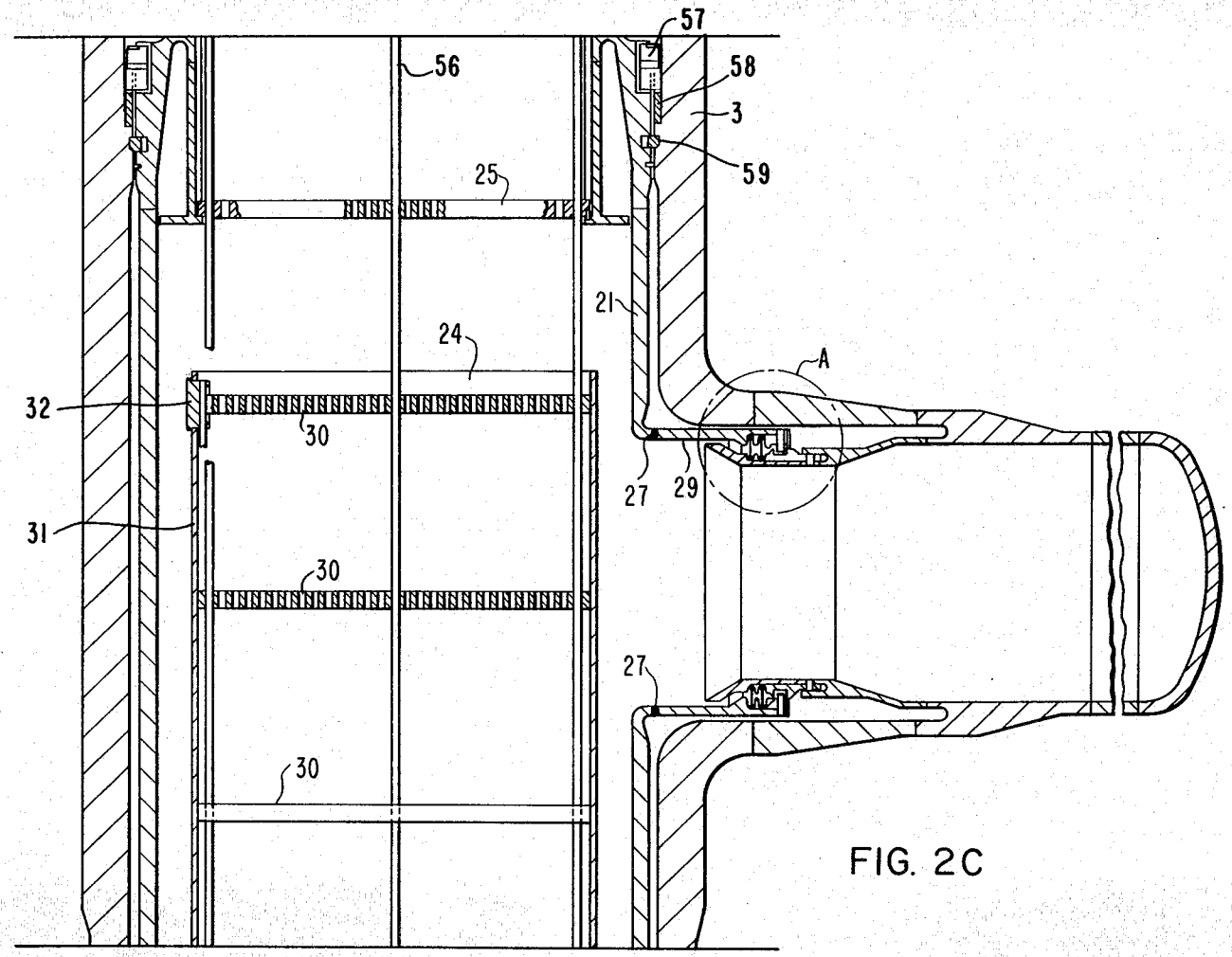

Modifications to Prevent Vibration of the Tubes (FIGS. 1B, 2C)

A problem related to properly supporting tubes 2 in the elbow region is the potential for damage from flow induced vibration of the flexible spans of tubes 2 in the elbow region because of the low natural frequency of the tubes and potentially large amplitudes of the vibrations. Vibration dampers could be used but these are difficult to design and still permit free tube 2 motion during thermal expansion. Vibration of tubes 2 in the bend area is considered to come from sodium flow entering the bundle inlet 24. Bundle inlet 24 is the region at the top of the shroud.

This invention greatly reduces vibration in the bend area of tubes 2 by lowering the position of bundle inlet 24 with respect to inlet nozzle 1 thus separating the bent portion of tubes 2 in the elbow region and the vibration excitation forces. The two existing spacer plates 25 (see FIGS. 2B and 2C) have been separated an additional amount over prior art effectively isolating the tubes from the excitation forces. Frequencies that can bypass these two separated plates 25 do not occur in the steam generator. These features have been demonstrated by calculations. In addition, lowering the bundle 24 inlet minimizes thermal fatigue and transient problems in the elbow region due to inlet flow penetration into the elbow. This is considered to be a significant improvement.

Figure 4:
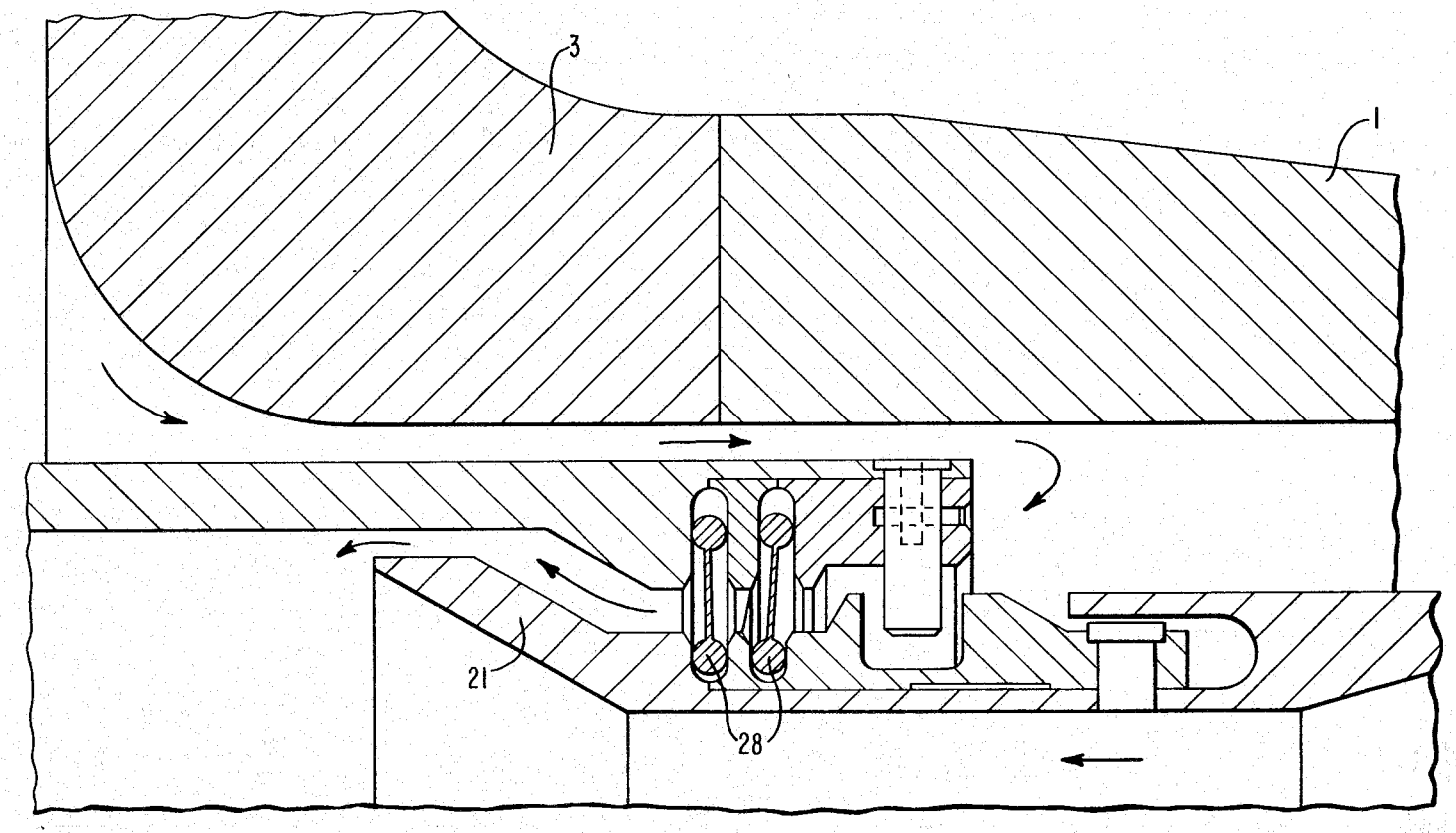
FIG. 4 is an enlargement of a portion of FIG. 2C.
Figure 5:
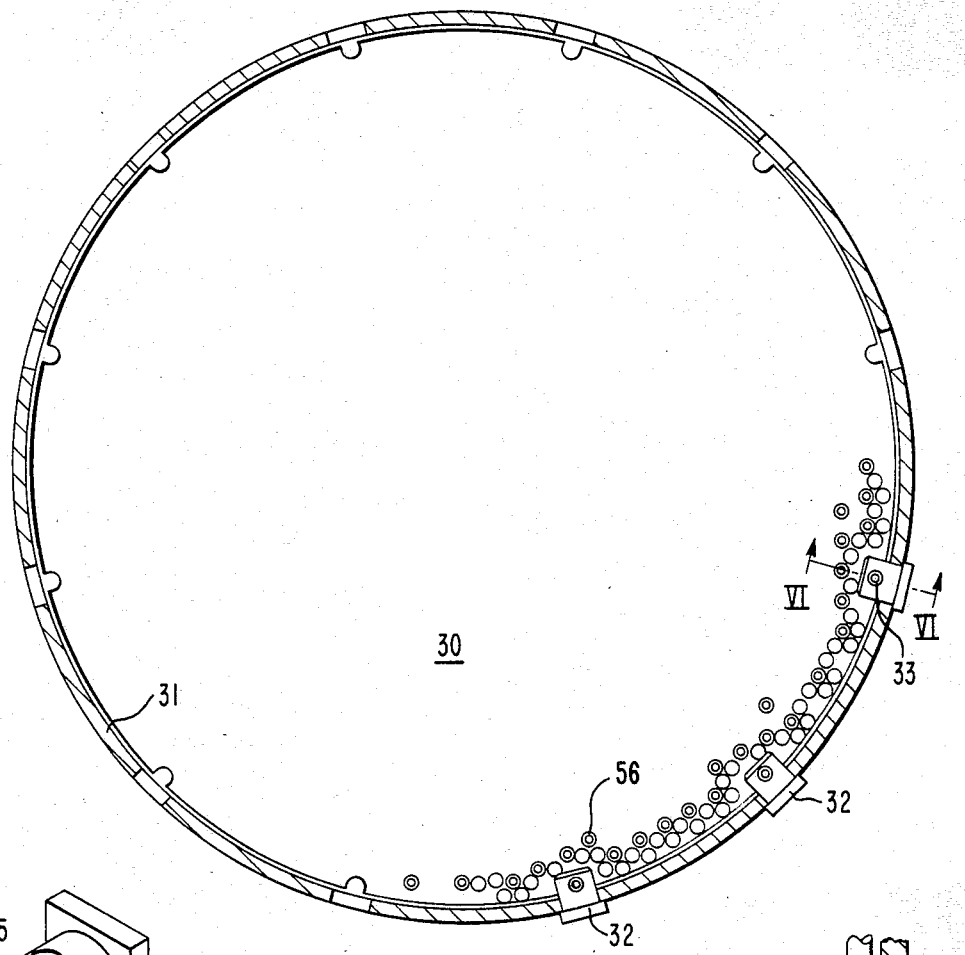
FIG. 5 is a section from FIG. 2E.
Figure 8:
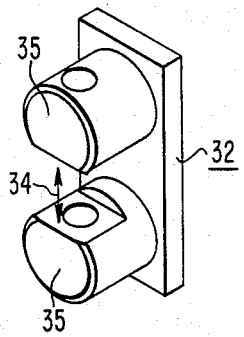
FIG. 8 is an isometric of a spacer retainer.
Figure 7:
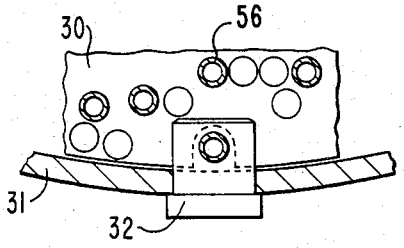
FIG. 7 is a section from FIG. 6.
Figure 6:
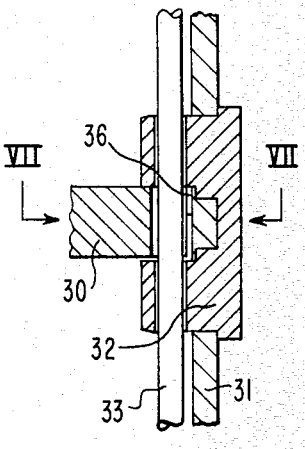
FIG. 6 is a section from FIG. 5.

Inlet Thermal Liner/Nozzle Liner Seal (FIGS. 1B, 2C, 4)

The prior state of the art utilizes a mechanical connection between the inlet thermal liner 21 and a nozzle liner 26. This invention utilizes a weld connection 27 between inlet thermal liner 21 and a labyrinth disc seal to limit flow through the nozzle annulus. The direction of flow is controlled during steady state operation by having a lower static pressure at a step in the seal which forces the flow out from discs 28. The weld between the inlet thermal liner 21 and nozzle seal is a stainless steel weld. This is important because the weld can be accomplished without preheat and post-weld heat treatment which would be required if a $2\frac{1}{4}$ chromium-1MO liner were used. The seal discs 28 provide a convenient place for interfacing between the stainless steel liner 21 and the $2\frac{1}{4}$ chromium-1MO inlet nozzle.

The seal itself is considered to be a novel design having a general shape of an annular disc 28 with an inner edge expanded to have a circular cross section and an outer edge expanded to have a circular cross section. In two dimensions a cross section of the seal appears as two balls connected by a straight section, as in FIG. 4. One of the two "balls" will always be in contact with a sealing surface whatever direction $\Delta T$ expansion occurs.

Figure 10A:
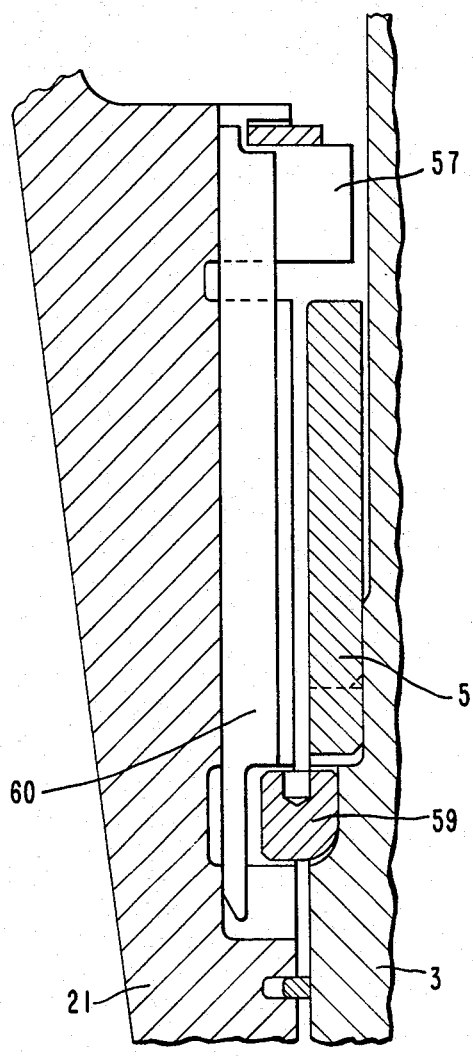
FIG. 10A is an enlargement of a portion of FIG. 2C.
Figure 10B:
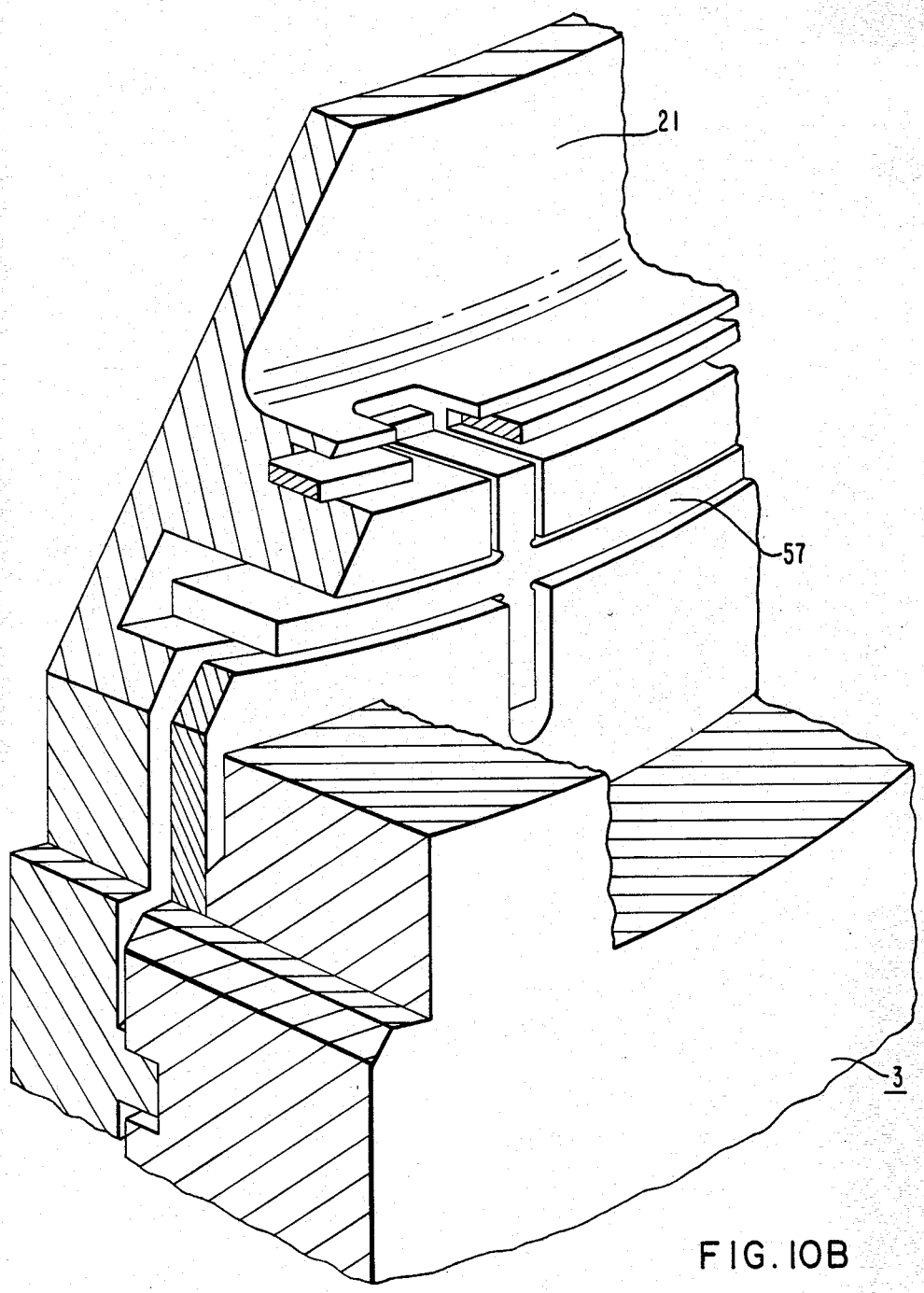
FIG. 10B is an isometric showing cruciform radial keys.

Inlet Thermal Liner/Elbow Shroud Support Means (FIGS. 2C, 10A, 10B)

By the prior art, the support of the thermal liner 21 and elbow shroud 14 has been by bolted connections. By this invention, the support of the integral thermal liner 21 and elbow shroud 14 is accomplished with a radial key arrangement. These keys 57 are Inconel 718 and are mechanically attached to the stainless steel thermal liner 21. The radial keys 57 prevent lateral motion or vibration. The keys have integral pads which support the thermal liner and elbow shroud on the inlet header. These keys mate with a separate set of keyways machined into a ring 58 that is fitted into the inside diameter of the inlet header. The separate ring prevents placing stress concentrations in the shell and facilitates angular adjustment of the keyway orientation. The keys and integral pads permit sliding during thermal differential expansion between the stainless steel thermal liner and $2\frac{1}{4}$ chromium-1MO shell. Uploads on the assembly are reacted by a shear ring 59 which is locked in place by pins 60 that facilitate installation and removal.

The keys 57 which may have a cruciform cross section are an appropriate location to accomplish the interface between the stainless steel thermal liner and the $2\frac{1}{4}$ chromium-1MO shell.

Attachment of Spacer Plates (FIGS. 2C, 2D, 2E, 2F, 5, 6, 7, 8)

In various places along the straight section of the steam generator, spacer plates 30 are used to provide support and proper spacing for the array of tubes 2. These spacer plates 30 according to the prior art are attached to a shroud 21 by bolts. According to this invention, a unique spacer retainer 32 will be used to support the spacer plates 30 and to react vertical loads. This method allows the spacer plate 30 to float freely within the clearance between the shroud 31 inner diameter and the spacer plate 30 outer diameter. This floating feature is very important because it provides flexibility to the tube array which relieves some of the tube 2 side loads by permitting small side deflections. This ultimately reduces the axial frictional loads and potentially tube 2 buckling, jamming and subsequent failure. According to this invention, a plurality of tube spacer retainers 32 are locked to the shroud 31 by tube spacer retainer bars 33 located at intervals around the parameter of shroud 31. Spacer plates 30 are inserted into a gap 34 between two lugs 35 on the tube space retainer 32. A small gap 36 exists between the outer diameter of the spacer plate 30 and the flat surface of the tube space retainer 32 (see FIG. 6). This gap 36 is the interval within which the spacer plate 30 can float freely.

Figure 2E:
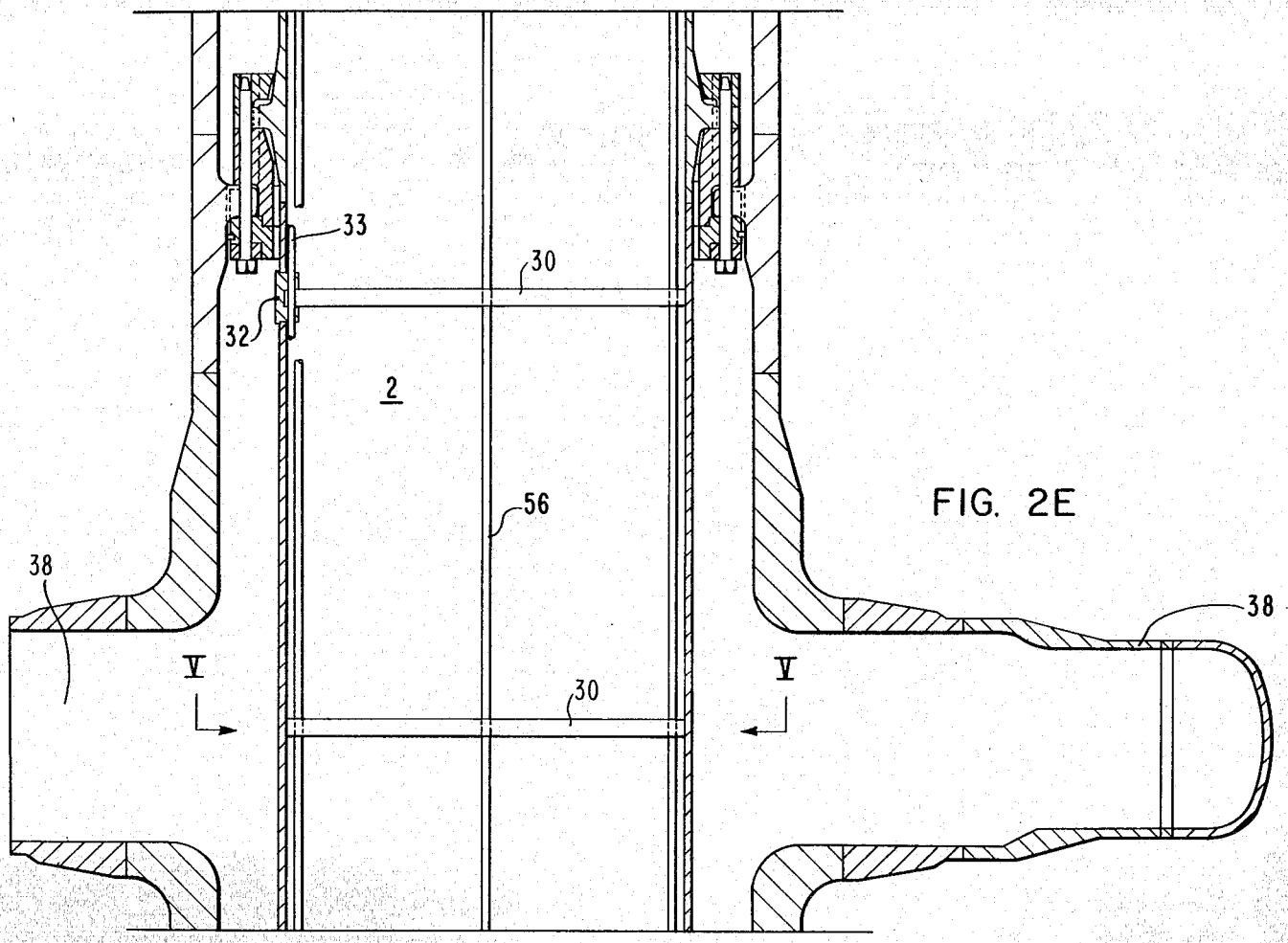
Figure 2F:
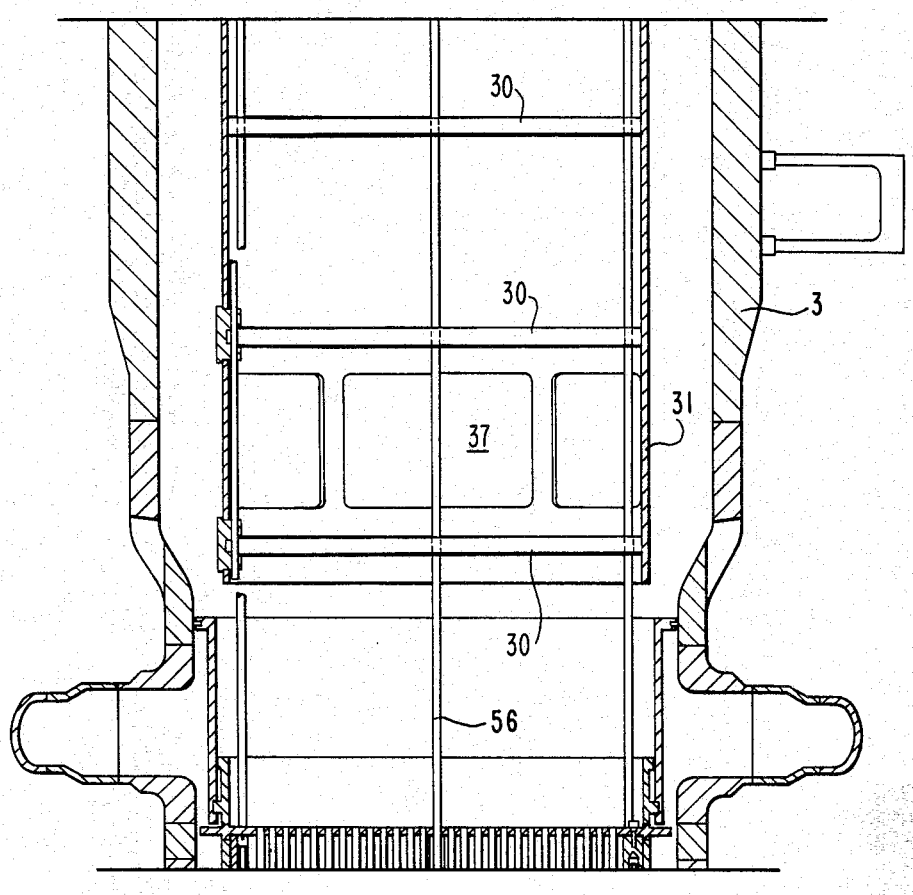
Figure 2G:
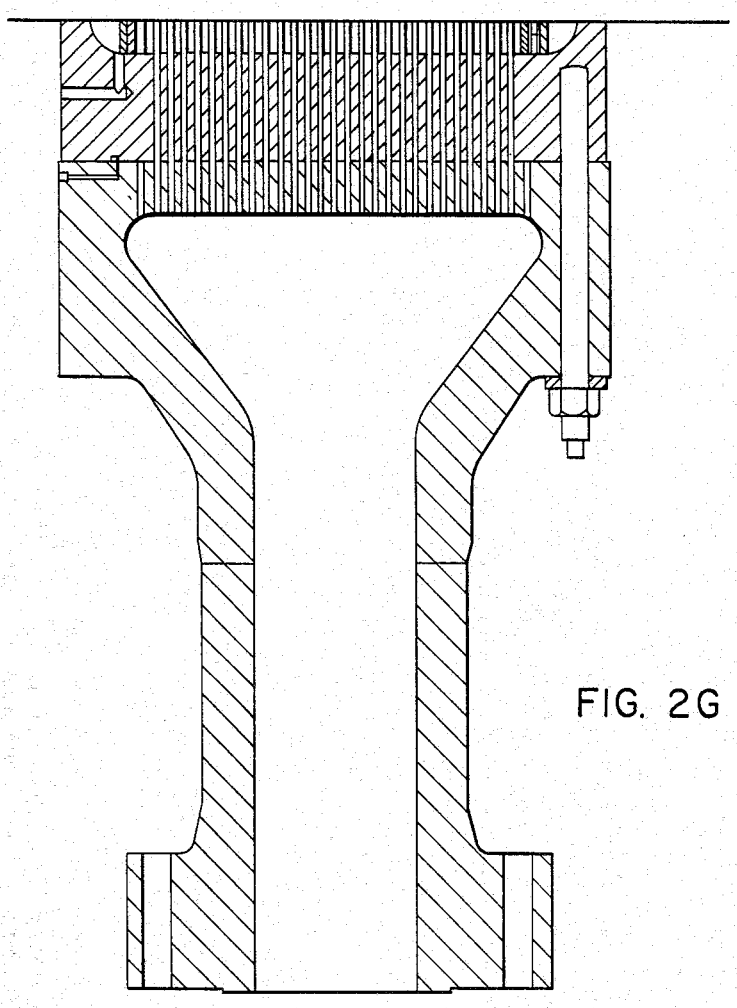

Bundle Outlet Location (FIGS. 1B, 2E, 2F)

According to this invention, the bundle outlet 37 is to be lowered with respect to the sodium outlet 38. There are two reasons for lowering the bundle outlet 37. First it is necessary to compensate for the heat transfer area lost in lowering the bundle inlet 24 but more important is the elimination of a stagnant sodium region in the bottom of the steam generator. Eliminating the stagnant sodium region prevents a washing of a hot-cold interface on the vessel shell 3 which could result in thermal fatigue failure of the shell 3. By lowering the bundle outlet 37 the bundle outlet flow penetrates the area that was once stagnant and continually flushes out the region such that a hot-cold interface can never develop. The bundle outlet 37, as shown in the drawings, is approximately 18 inches lower than in the prior art.

Shroud Support Means (FIGS. 1B, 2D, 2E, 9, 10A, 11)

Figure 9:
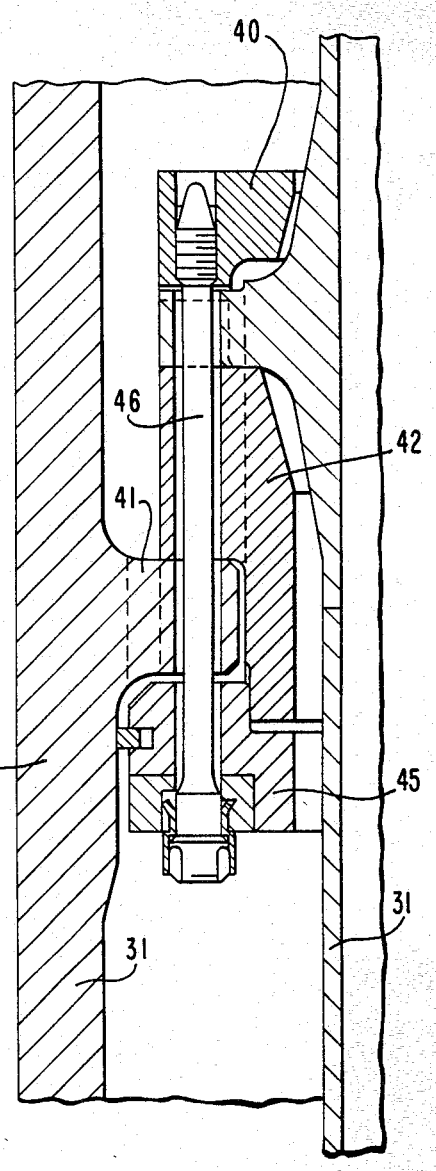
FIG. 9 is an enlargement of a portion of FIG. 2E.
Figure 11:
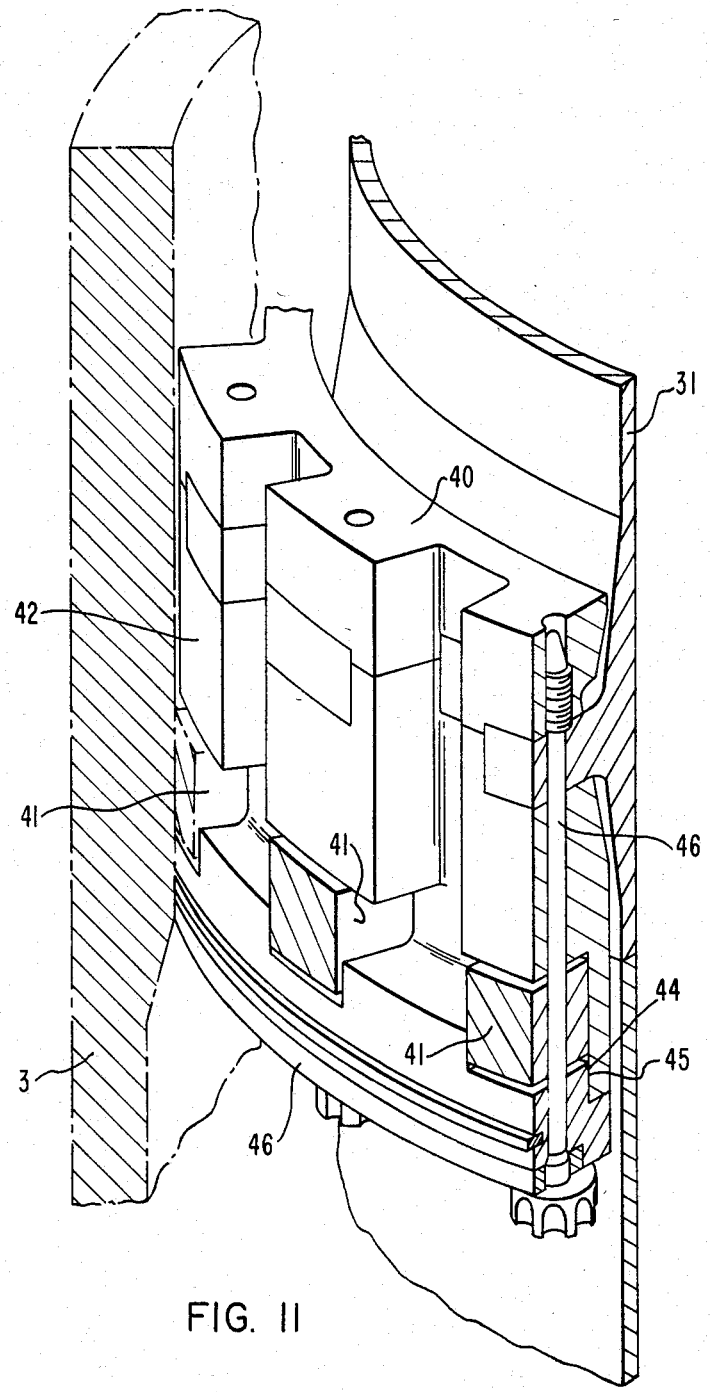
FIG. 11 is an isometric of a shroud support system.

By the prior art, the cylindrical shroud 31 has generally been supported at the top by means of bolts which attach to a flange (not shown) on the side of the shell. It is desired to install shroud 31 from the bottom to facilitate welding operations on the thermal liner 21 and on the nozzle liner 26. Installation of shroud 31 from the bottom eliminates the use of a flange unless the bolts can stay under tension indefinitely which is undesirable. Consequently, a new method for supporting shroud 31 has been developed by which means shroud 31 is to be supported generally at a bottom position 39 with a vibration dampening arrangement at a top location 40. FIGS. 9, 10A and 11 show the support means of shroud 31. Nut plate 40 is attached to shroud 31. Shroud 31 is inserted into shell 3 from the bottom and inserted sufficiently that nut plate 40 slides past lugs 41 which are an integral part of shell 3 and then shroud 31 and nut plate 40 are rotated. Main support ring 42 is also inserted from the bottom, sliding past lugs 41 and then rotated. Lower support ring 43 forms a key with lugs 41 on shell 3. Main support ring 42 forms a key with shroud 31. The main support ring 42 and the lower support ring 43 meet on a diameter (point 44) so translation with respect to each other is impossible. The assembled support therefore allows radial expansion due to temperature changes while providing vertical support for the shroud and angular misalignment compensation.

The purpose of the bolt 45 is to provide support for shipping and during accidents.

The nut plate 40, the main support ring 42, the lower support ring 43 and the bolt installation ring 46 are all composed of type 718 nickel alloy. The shroud and the shell are $2\frac{1}{4}$ chromium-1MO.

Figure 12:
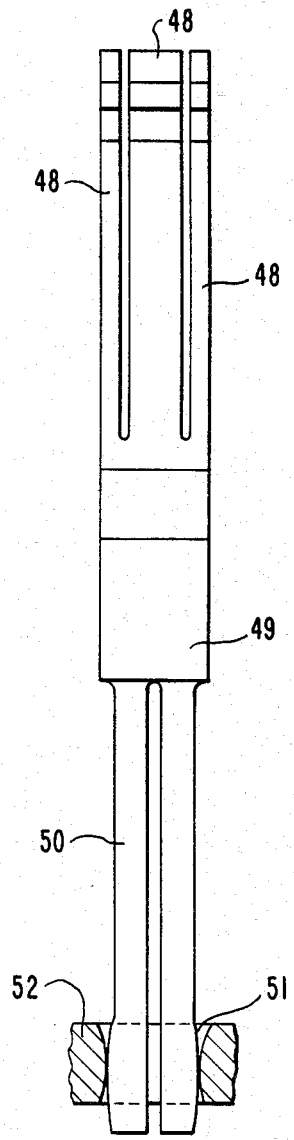
FIG. 12 is a detail from FIG. 2D.

Refer to FIGS. 1, 2D, and 12 which show the vibration damper 47. The vibration damper 47 is used to dampen vibrations of thermal liner 21 and shroud 31. One vibration damper 47 does both. The vibration damper 47 is designed to dampen vibrations as induced by flow. Seismic vibrations are accommodated by translations of thermal liner 21 and shroud 31 causing bumping contact on provided bumping surfaces of shell 3. This type of solution is not available for flow induced vibration due to the potential for wear. A plurality of leaf springs 48 integral to a ring 49 which is itself attached to thermal liner 21 bear on shell 3 and are used to dampen out vibrations in the bottom of thermal liner 21. Extending downward from the lower surface of the same ring 49 are a plurality of springs 50 in the shape of tuning forks. Each tuning fork 50 is compressed when it enters a notch 51 in a top ring 52 on the thermal liner 31. Both the leaf springs and the tuning fork configurations dampen out or eliminate vibrations by frictional force generated by movements within the notch or against the shell associated with vibrational translations. Cantilevered beams or arms made of nickel alloy 718 preserve flexibility of the internals to permit axial expansion without jamming in notch 51.

Various modifications may be made to this steam generator without departure from the true spirit and scope of the invention. For example, the shape of the bent region of the steam generator can have different degrees of bend or otherwise different geometric shape. Therefore, this specification should be considered illustrative rather than limiting.

We claim:

1. A steam generator for a liquid metal fast breeder nuclear reactor comprising:

a J-shaped tube bundle disposed between tube sheets and mounted in a J-shaped housing surrounding said tube bundle, the major portion of said tube bundle and said housing being vertically oriented and a smaller portion of said tube bundle and said housing being bent through at least about 90° and extending from the upper portion of said vertically oriented tube bundle major portion to provide for differential thermal expansion between said tube bundle and said shell;

a vertically oriented shroud member surrounding the substantial portion of said vertically oriented tube bundle, said vertically oriented shroud member being spaced from the inner surface of said shell, and an elbow shroud member surrounding said bent tube bundle portion and spaced from the nearest tubes of said bent tube bundle portion;

during operation of said steam generator, liquid metal is pumped into said shell through an inlet proximate the upper portion of said vertically oriented shell portion to flow downwardly through said tube bundle within said vertically oriented shroud member and about the individual tubes of said vertically oriented tube bundle and then to flow radially from the lower portion of said tube bundle and then to flow from an exit proximate the lower portion of said vertically oriented shell, and heat transfer fluid flowing upwardly through the tubes of said vertically oriented tube bundle to be heated by said liquid metal and then to exit from said bent tube bundle portion;

a plurality of tube spacer plate members horizontally disposed within said vertically oriented shroud member and operable to maintain the proper radial spacing between individual tubes, said spacer plate members spaced a small amount from the inner surface of said vertically oriented shroud member to permit a small radial deflection of said supported tubes; and a plurality of support grid members supported within said elbow shroud for supporting the individual tubes within said bent tube bundle, and said support grid members providing lateral tube support for every other row of tubes within said bent tube bundle to permit expansion of said tubes in a vertical direction without tube buckling or binding.

2. The steam generator as specified in claim 1, wherein said smaller portion of said tube bundle and said smaller portion of said housing are bent through 180°.

3. The steam generator as specified in claim 1, wherein both said elbow shroud and said bent shell portion have the configuration of a circular arc, with the centers of said circular arcs being offset from each other by a small amount to compensate for tube expansion to maintain a minimum gap between said bent tube bundle portion and said elbow shroud.

4. The steam generator as specified in claim 1, wherein said vertically oriented shroud member has an inlet portion at the top thereof to permit ingress of liquid metal into the top portion of said vertically oriented tube bundle, and said inlet portion of said vertically oriented shroud member is spaced from said bent tube bundle portion so that any vibrations do not reach said bent tube bundle portion.

5. The steam generator as specified in claim 1, wherein during operation thereof, liquid metal flow from said tube bundle is lower than the liquid metal exit from said shell to prevent the development of stagnant liquid metal in the bottom portion of said steam generator.

6. The steam generator as specified in claim 1, wherein a thermal liner is provided within said shell proximate the liquid metal entry inlet thereof, and said elbow shroud is affixed to said thermal liner by a weldment.

7. The steam generator as specified in claim 6, wherein a vibration dampening support structure is associated with said vertically oriented shroud member and said thermal liner and said shell, said vibration dampening support structure comprising spring members affixed to said vertically oriented shroud and said thermal liner and bearing on the inner surface of said shell.

8. An improved J-shaped steam generator for a liquid metal fast breeder reactor plant having a plurality of support grids in the bend region of said steam generator, each of said support grids adapted to provide lateral support to every other row of an array of tubes through said steam generator.

9. The steam generator according to claim 8 in which four support grids in the bend region provide support to said tubes, said support grids being out of phase such that a given row of tubes is supported by alternate support grids.

* * * * *